US011412849B2

(12) United States Patent
Cattaneo

(10) Patent No.: US 11,412,849 B2
(45) Date of Patent: Aug. 16, 2022

(54) ATTACHMENT FOR FURNITURE FEET ADJUSTABLE IN HEIGHT

(71) Applicant: Leonardo S.r.l., Figino Serenza (IT)

(72) Inventor: Carlo Cattaneo, Figino Serenza (IT)

( * ) Notice: Subject to any disclaimer, the term of this patent is extended or adjusted under 35 U.S.C. 154(b) by 0 days.

(21) Appl. No.: 17/277,247

(22) PCT Filed: Sep. 24, 2019

(86) PCT No.: PCT/IB2019/058082
§ 371 (c)(1),
(2) Date: Mar. 17, 2021

(87) PCT Pub. No.: WO2020/065521
PCT Pub. Date: Apr. 2, 2020

(65) Prior Publication Data

US 2021/0315381 A1 Oct. 14, 2021

(30) Foreign Application Priority Data

Sep. 26, 2018 (IT) ..... 102018000008934

(51) Int. Cl.
*A47B 91/02* (2006.01)

(52) U.S. Cl.
CPC ..... *A47B 91/022* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,991,805 | A * | 2/1991 | Solak | F16M 7/00 248/188.4 |
| 5,398,620 | A * | 3/1995 | Rouch | F16M 7/00 108/1 |
| 6,892,435 | B2 * | 5/2005 | Cattaneo | A47B 13/021 29/525 |
| 10,638,839 | B2 * | 5/2020 | Cattaneo | A47B 91/028 |
| 2004/0074096 | A1 * | 4/2004 | Cattaneo | A47B 13/021 29/897 |
| 2007/0205342 | A1 * | 9/2007 | Gabriel | F16M 7/00 248/188.4 |
| 2018/0368574 | A1 * | 12/2018 | Cattaneo | A47B 91/028 |
| 2019/0003505 | A1 * | 1/2019 | Cattaneo | A47B 91/028 |

FOREIGN PATENT DOCUMENTS

| | | | | |
|---|---|---|---|---|
| EP | 1211429 | A1 * | 6/2002 | A47B 13/021 |
| EP | 2653068 | | 10/2013 | |
| EP | 2839761 | A1 * | 2/2015 | A47B 91/028 |
| WO | WO-2005115199 | A1 * | 12/2005 | A47B 91/028 |
| WO | 2017153188 | | 9/2017 | |

* cited by examiner

*Primary Examiner* — Monica E Millner
(74) *Attorney, Agent, or Firm* — Themis Law

(57) ABSTRACT

An attachment for furniture feet adjustable in height with respect to a piece of furniture includes a body having a seat adapted to firmly receive an upper end of a foot adjustable in height, four pass-through openings for the passage of a maneuvering tool of an adjustment mechanism of at least one additional foot adjustable in height, the openings being arranged at 90° with respect to each other and lying along two symmetry axes, orthogonal to each other, of the body.

11 Claims, 4 Drawing Sheets

11

17
25

11
Z
22
30

24
11
12

11
17
22
25
22
12

ATTACHMENT FOR FURNITURE FEET ADJUSTABLE IN HEIGHT

The present invention relates to an improved attachment for furniture feet adjustable in height.

In the field of furniture or similar furnishing items, supporting feet of the whole overlying structure are positioned beneath a bottom or last lower shelf.

These feet are generally positioned beneath the furniture thanks to the presence of an element called "attachment".

Attachments are known in the known art, which are provided with a passage for a tool or an access for front adjustment, in particular when the rear feet need to be adjusted.

The placement of these attachments requires an orientation based on their front or rear positioning with respect to the front of the furniture from which access is made for adjustment.

The identification of this orientation involves a certain difficulty or in any case requires special attention for the assembler who must identify the exact final front and/or rear and right and/or left position also with respect to the shoulder and front of the furniture.

The general objective of the present invention is to provide an improved attachment for furniture feet adjustable in height, capable of solving the above-mentioned drawbacks of the known art in an extremely simple, economical and particularly functional manner.

A further objective of the present invention is to provide an improved attachment for furniture feet adjustable in height with extremely simplified and rapid assembly, within the reach of the assembler without particular expedients.

Another objective of the present invention is to provide an improved attachment for furniture feet adjustable in height which can be produced in large quantities at a reduced cost and which can be mounted without the aid of particular tools.

Yet another objective of the present invention is to provide an improved attachment for furniture feet adjustable in height with a reduced cost.

A further objective of the present invention is to provide an improved attachment for furniture feet adjustable in height which is actually indifferent to any orientation during its assembly on the bottom of the furniture.

The above-mentioned objectives are achieved by an improved attachment for furniture feet adjustable in height produced according to the independent claim 1 and the following subordinate claims.

The structural and functional characteristics of the present invention and its advantages with respect to the known art will appear even more evident from the following description, referring to the attached schematic drawings, which show an embodiment example of the same invention. In the drawings.

Figure 1:
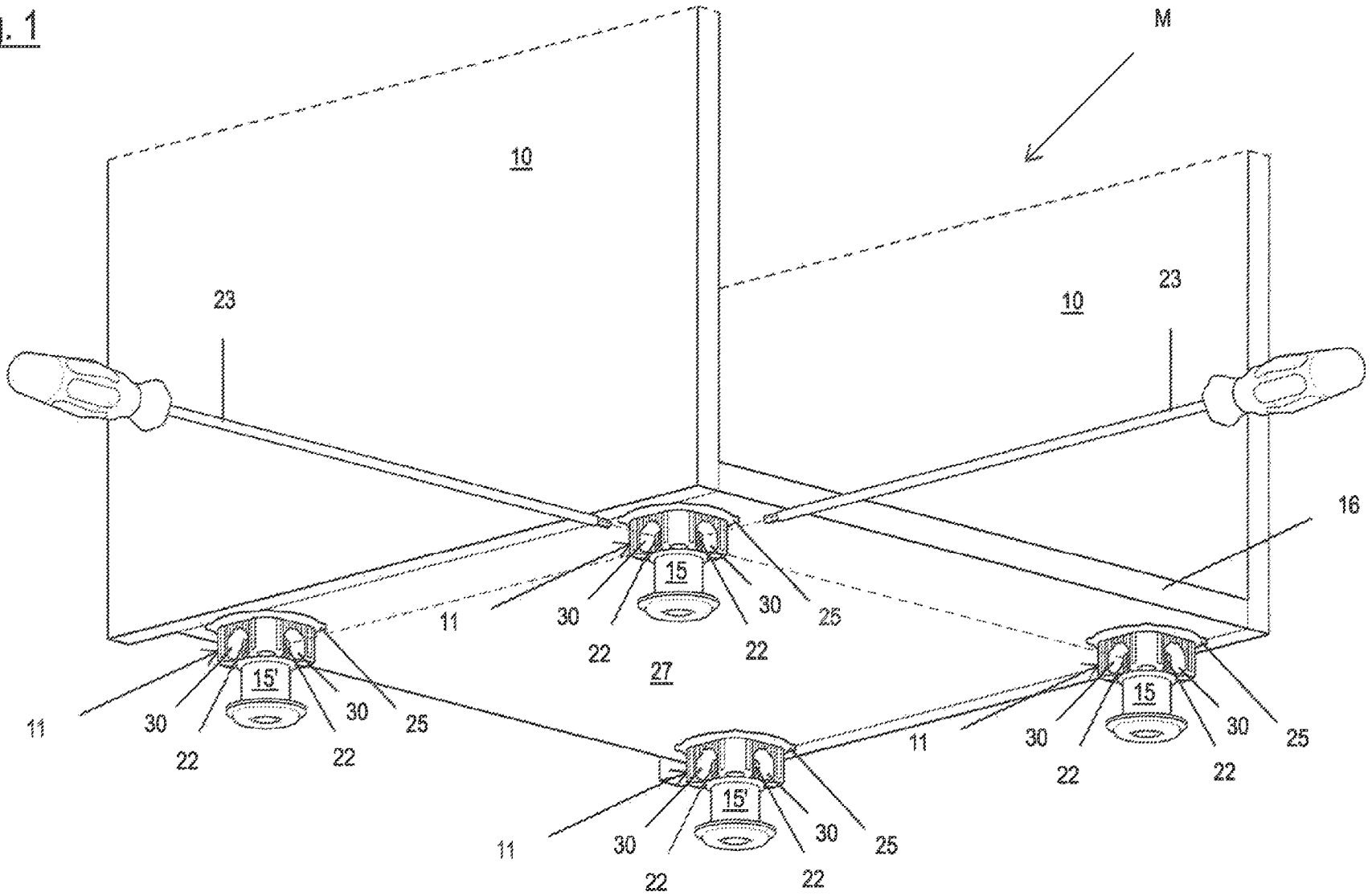
FIG. 1 shows a perspective view of two pairs of attachments according to the present invention provided with a foot and arranged beneath a bottom or shelf of a piece of furniture.

With reference to the figures, by way of non-limiting example, these show an embodiment of an improved attachment, indicated with 11, used for furniture feet adjustable in height with respect to a piece of furniture M, provided with at least one shoulder 10 and a bottom 16, and a supporting floor P.

An attachment according to the invention is of the type comprising: a box-shaped body, indicated as a whole by 12, provided with a seat 13 suitable for firmly receiving an upper end of a foot adjustable in height 15, 15'.

In the example shown, the box-shaped body 12 is moulded and has, in an upper part, coupling and fixing elements to a bottom 16 of the furniture M.

These coupling and fixing elements can be defined by an expansion plug 17, arranged along an axis Z in a vertical direction perpendicular to that of the bottom 16 where a blind hole 18 is provided for said expansion plug 17.

Alternatively and/or simultaneously, the above-mentioned coupling and fixing elements can be defined by four pass-through holes 19 suitable for receiving screws or other fixing elements (not shown) which can be aligned with holes 20 to be produced or formed in the bottom 16 of the furniture M.

The pass-through holes 19 are produced for example as tubular segments in ribs 21 of the box-shaped body 12 of the attachment 11.

Figure 2:
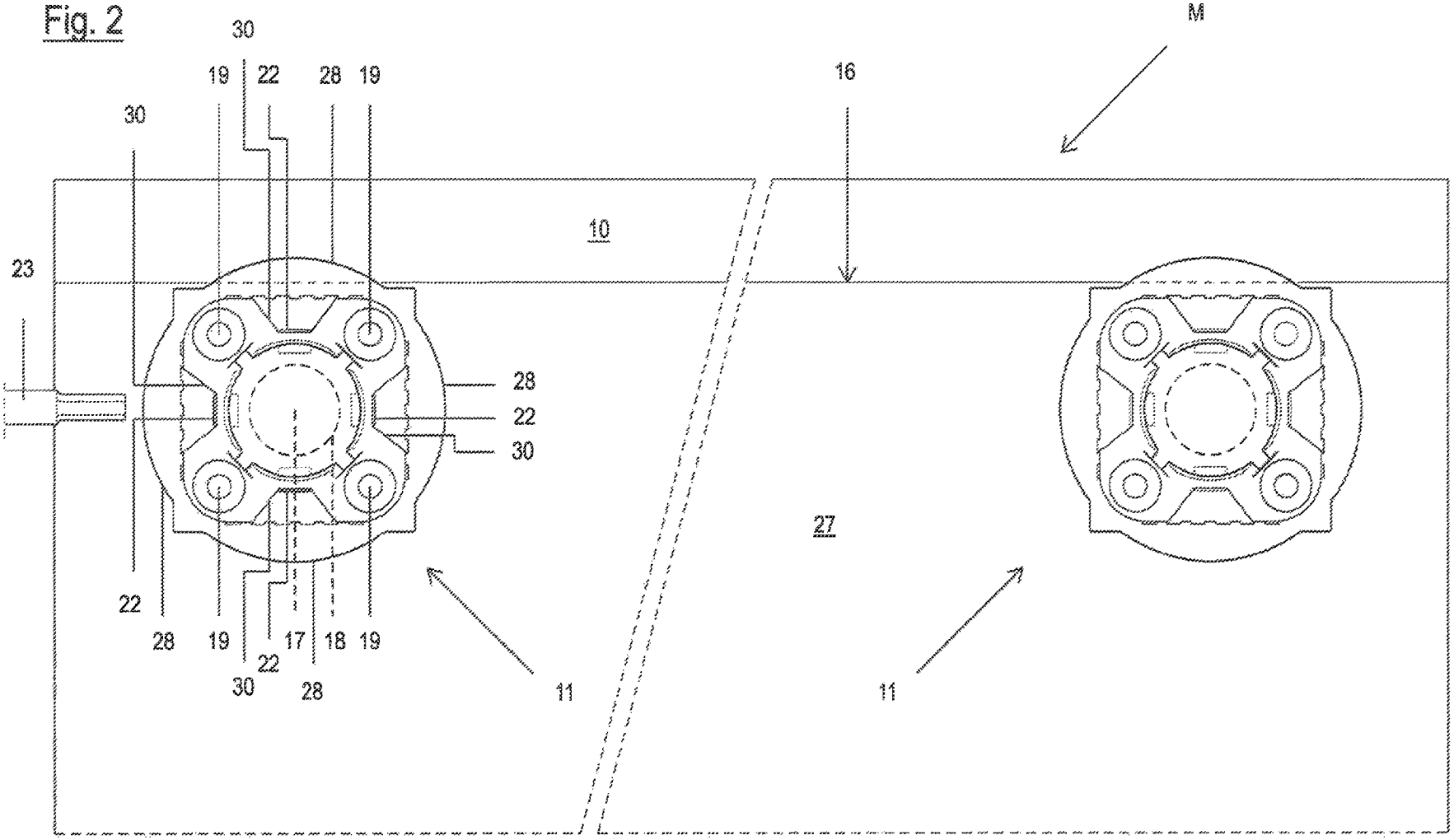
FIG. 2 shows a plan view from below of the two attachments for feet shown in FIG. 1.
Figure 3:
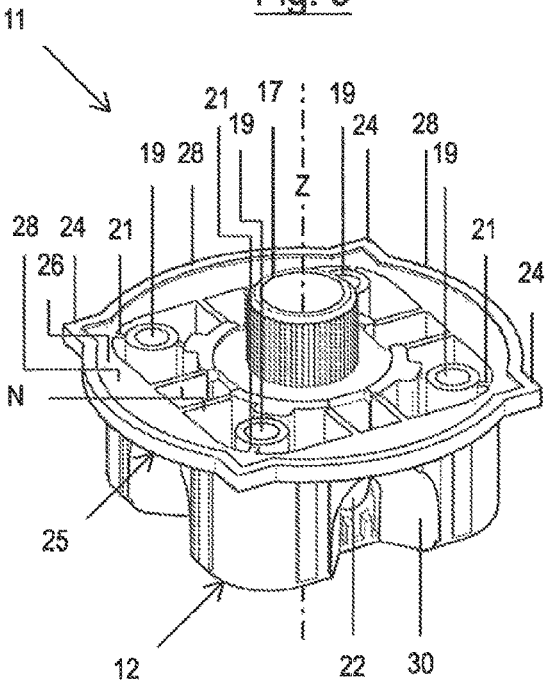
FIGS. 3 and 4 are two perspective views from above and below showing an attachment according to the present invention.
Figure 4:
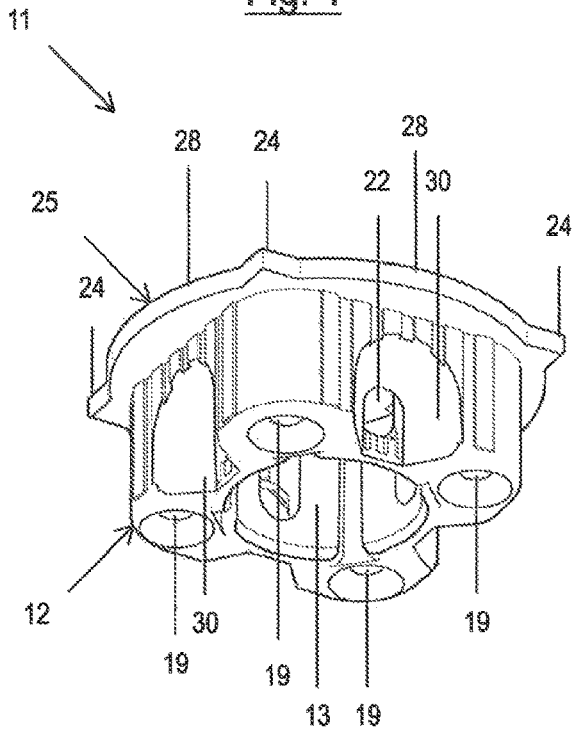
Figure 5:
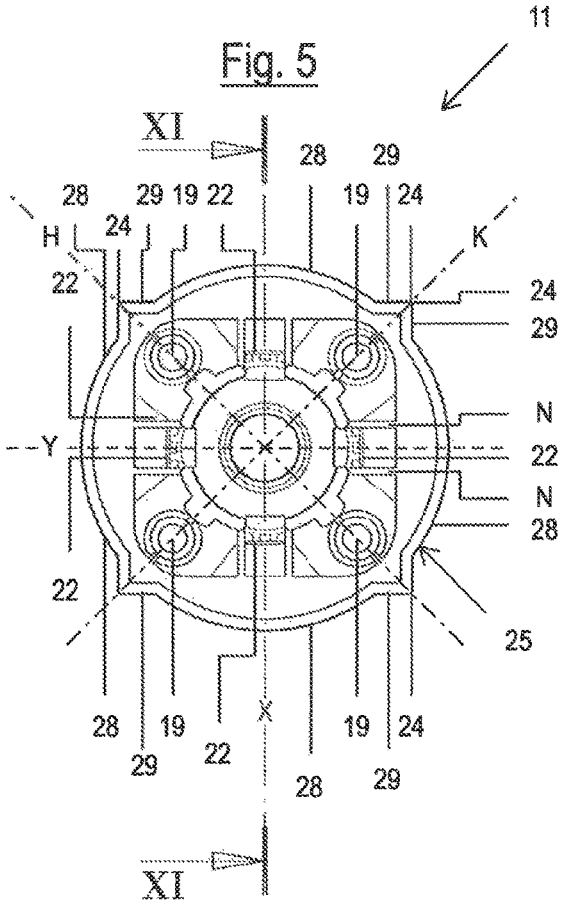
FIGS. 5 and 6 are two plan views from above and below showing an attachment according to the present invention.
Figure 6:
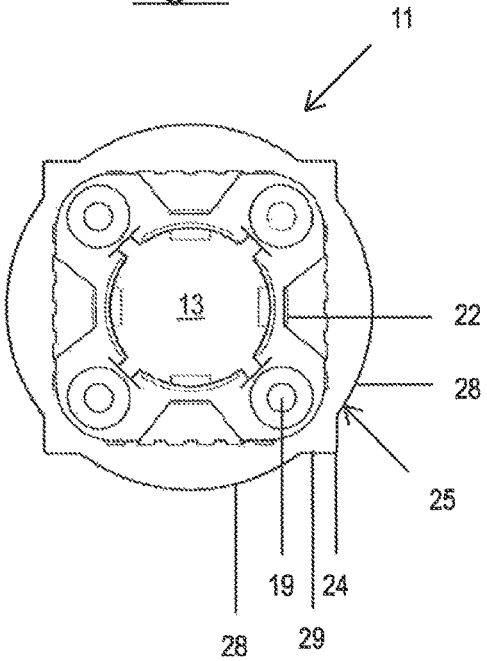
Figures 7, 8, 9, 10, 11:
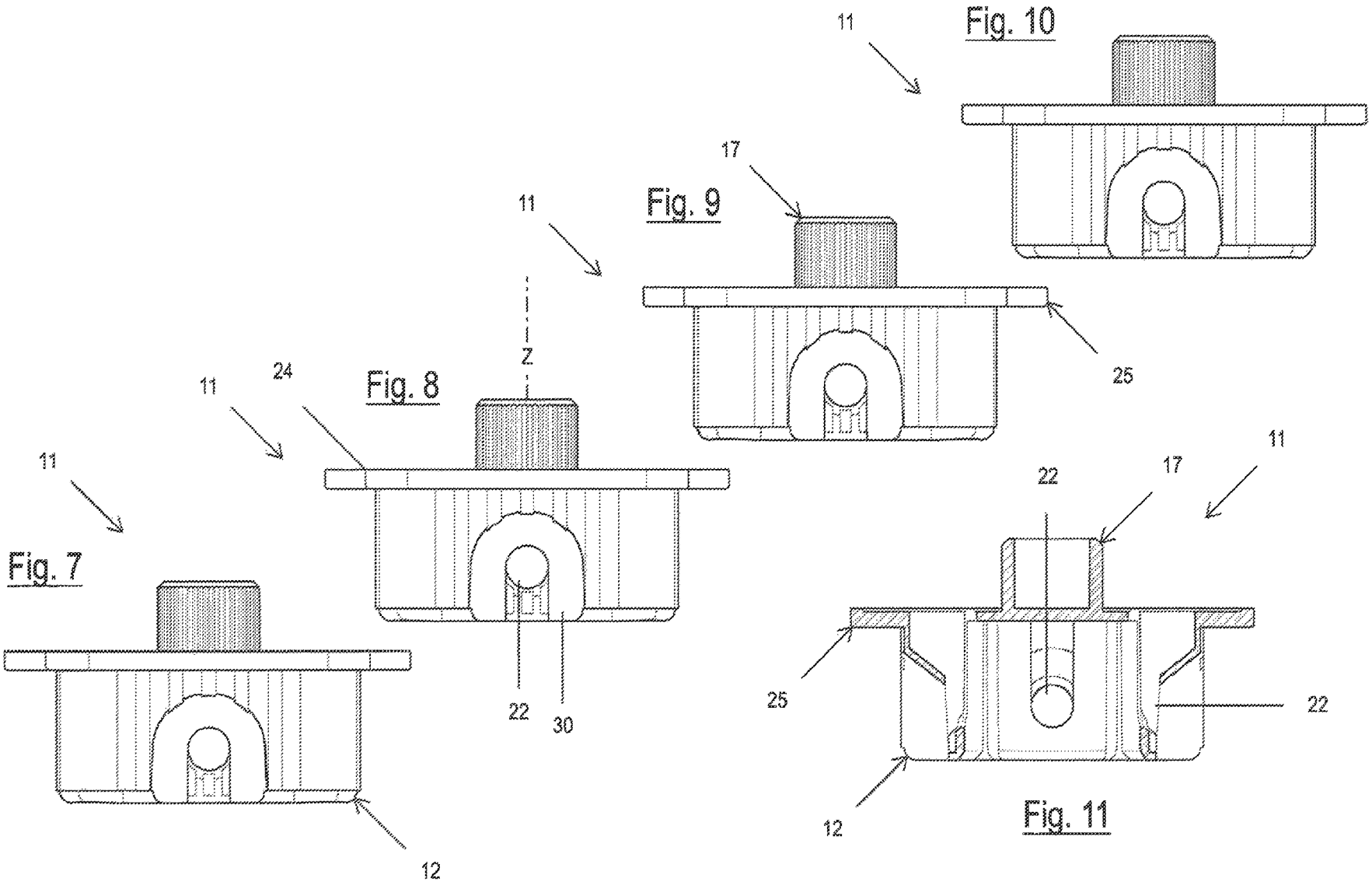
FIGS. 7,8,9 and 10 are raised side views of the four sides of an attachment according to the present invention.
FIG. 11 is a sectional view along the line XI-XI of FIG. 5 of an attachment according to the present invention.

As can be better seen from the figures, the attachment 11 of the present invention is characterized in that it also comprises, in its body 12, four pass-through openings 22 for the passage of a manoeuvring tool, such as the tip of a screwdriver 23. This tool is suitable for enabling an adjustment mechanism (not shown) of at least a further second height-adjustable foot 15', such as a rear foot, aligned with a first foot 15, such as a front foot, as shown for example in FIGS. 1 and 2.

The body 12 also provides that the four above-mentioned openings 22 be arranged at 90° with respect to each other and lie along two symmetry axes X and Y of said body orthogonal to each other.

It should also be noted that the body 12 also provides two further symmetry axes H and K which are also orthogonal to each other.

In particular, in the example shown, these two further symmetry axes H and K, orthogonal to each other, extend between four edges 24 of a shaped flange 25 positioned as the upper layer or surface 26 of the body 12 of the attachment 11. This upper layer or surface 26 of the attachment 11 is arranged and suitable for abutting against a lower flat surface 27 of the bottom 16 of the furniture M.

The upper layer or surface 26 of the attachment 11 provides arched linear sections 28 alternating with straight sections 29 arranged for forming the corners 24 of the shaped flange 25.

Furthermore, in the example shown, the body 12, which as mentioned can be moulded, has a substantially square-shaped section, but that can be identically circular or round.

The four pass-through openings 22 in the body 12 of the attachment 11 are provided with countersinks 30 for the passage of the tip of the manoeuvring tool, such as the tip of a screwdriver 23.

The body 12 of the attachment can be provided with a series of additional ribs N whose sole purpose is to lighten and minimize the material used, and also for reinforcing the body itself.

With an attachment 11 according to the present invention, the assembler using it is no longer obliged to orient the attachment itself in the positioning step as, as can be seen, it appears as the only front/rear right/left piece for receiving front/rear right/left feet.

As already mentioned, the attachment 11 of the present invention provides four pass-through openings or accesses 22 and is symmetrical with respect to the four axes X, Y, H and K, affirming that this type of attachment is four times symmetrical.

It can also be noted that an attachment of the present invention has a shape that favours and/or self-guides the alignment of the access holes 22 orthogonally and parallelly with respect to the shoulder 10 and the front of the furniture. Its shape allows the attachment to be optically aligned with respect to the shoulder 10 of the furniture M.

It can also be noted from FIGS. 7, 8, 9 and 10 that the attachment of the present invention has four identical sides of the body 12 which favour its correct positioning.

Its fixing with a double possibility of choice gives the product a considerable advantage, facilitating the assembly operations also in view of possible sudden and unexpected difficulties.

An attachment according to the present invention is capable of allowing front adjustment even in precarious operating conditions.

The presence, for example, of the single expansion plug 17 or doubel allows a single hole to be produced in the bottom 16 of the furniture for each front or rear foot.

The objectives mentioned in the preamble of the description have thus been achieved.

The protection scope of the present invention is defined by the enclosed claims.

The invention claimed is:

1. An attachment for furniture feet adjustable in height with respect to a piece of furniture, comprising:

a body provided with a seat adapted to firmly receive an upper end of a foot adjustable in height; and four pass-through openings for passage of a maneuvering tool of an adjustment mechanism of at least one additional foot adjustable in height, each of said openings being arranged at 90° with respect to neighboring openings, each of said openings lying along one of two symmetry axes of said body, said symmetry axes being orthogonal to each other, wherein said body is provided with a flange extending along an entire perimeter of the body and arranged as an upper layer or surface of the body of the attachment.

2. The attachment according to claim 1, wherein said four pass-through openings are provided with countersinks for the passage of a tip of the maneuvering tool.

3. The attachment according to claim 1, wherein said body has hooking and fixing elements to a bottom of the furniture.

4. The attachment according to claim 3, wherein said hooking and fixing elements are defined by an expansion plug, arranged according to an axis perpendicular to an axis of the bottom.

5. The attachment according to claim 3, wherein said hooking and fixing elements are defined by four second pass-through holes configured to receive screws or other fixing elements to the bottom of the furniture.

6. The attachment according to claim 1, wherein said body has a square-shaped, circular, or round cross-section.

7. The attachment according to claim 1, wherein said body is produced by molding.

8. The attachment according to claim 1, wherein said flange is a shaped flange provided with four corners arranged as the upper layer or surface of the body of the attachment.

9. The attachment according to claim 8, wherein said shaped flange provides arched linear sections alternating with straight sections arranged to form said corners.

10. The attachment according to claim 1, wherein said body has four identical sides that favor a correct positioning thereof.

11. The attachment according to claim 1, wherein said body is a single front/rear, right/left piece adapted to receive front/rear, right/left feet.

* * * * *